US006572715B2

(12) United States Patent
Komine et al.

(10) Patent No.: US 6,572,715 B2
(45) Date of Patent: Jun. 3, 2003

(54) ALUMINUM ALLOY SUPPORT BODY FOR A PRESENSITIZED PLATE AND METHOD OF PRODUCING THE SAME

(75) Inventors: Hirotaka Komine, Oura-gun (JP); Mitsuo Ishida, Oura-gun (JP); Keitarou Yamaguchi, Susono (JP)

(73) Assignees: Kodak Polychrom Graphics, LLC, Norwalk, CT (US); Mitsubishi Aluminum Co., Ltd., Tokyo (JP)

( * ) Notice: Subject to any disclaimer, the term of this patent is extended or adjusted under 35 U.S.C. 154(b) by 0 days.

(21) Appl. No.: 09/778,501

(22) Filed: Feb. 7, 2001

(65) Prior Publication Data

US 2001/0050122 A1 Dec. 13, 2001

(30) Foreign Application Priority Data

Feb. 7, 2000 (JP) ..... 2000-029609
Feb. 7, 2000 (JP) ..... 2000-029611

(51) Int. Cl.[7] ..... C22C 21/00
(52) U.S. Cl. ..... 148/437; 420/548; 420/550
(58) Field of Search ..... 148/437; 420/548, 420/550

(56) References Cited

U.S. PATENT DOCUMENTS 4,686,083 A * 8/1987 Takizawa et al. ..... 420/548
5,795,541 A 8/1998 Tanigawa et al. ..... 420/520

FOREIGN PATENT DOCUMENTS

| | | | |
|---|---|---|---|
| EP | 0097318 | | 6/1983 |
| JP | 58221254 | | 12/1983 |
| JP | 59-067349 A | * | 4/1984 |
| JP | 62054051 | | 3/1987 |
| JP | 05156398 | | 6/1993 |
| JP | 08209313 | | 8/1996 |
| JP | 11229101 | | 8/1996 |
| JP | 9184039 | | 7/1997 |
| JP | 9272937 | | 10/1997 |
| JP | 11061364 | | 3/1999 |
| SU | 453445 A | * | 5/1975 |

OTHER PUBLICATIONS

"ASM Handbook: vol. 2 Properties and Selection: Nonferrous Alloys and Special–Purpose Materials", ASM International, 1990, p 17.*

Pan et al., "Effects of rare earth metals on electrical conductivity and mechanical properties of commercial purity aluminum", Materials Science and Technology, Nov. 1994, vol. 10, pp. 933–935.

Pan et al., "Effects of rare earth additions on the As–cast microstructure and intermetallic compounds in commercial–purity aluminum", XP–001005523, 1992, pp. 361–369.

Chemical Abstracts, vol. 82, No. 26, for SU 453 445.

English language abstract of JP 62148295.

* cited by examiner

*Primary Examiner*—George Wyszomierski
*Assistant Examiner*—Janelle Combs Morillo
(74) *Attorney, Agent, or Firm*—Faegre & Benson LLP

(57) ABSTRACT

The present invention provides an aluminum alloy support body for a presensitized plate in which the uniformity of the grained surface due to electrochemical etching is further improved, and a method of producing the same. The aluminum alloy support body for the presensitized plate according to the present invention has a composition comprising 0.1 to 0.7% by weight of Fe; 0.01 to 0.2% by weight of Si; 0.005 to 1.0% by weight of one or more rare earth elements; and the balance of Al and unavoidable impurities. In the present invention, the aluminum alloy support body may further contain 0.005 to 0.1% by weight of Ni and 0.005 to 0.3% by weight of one or more rare earth elements. One or more elements of Ce, La and Nd can be selected as the rare earth elements.

18 Claims, No Drawings

ALUMINUM ALLOY SUPPORT BODY FOR A PRESENSITIZED PLATE AND METHOD OF PRODUCING THE SAME

FIELD OF THE INVENTION

The present invention relates to an aluminum alloy support body for a presensitized plate used in lithographic printing and, more particularly, to an aluminum alloy support body for a presensitized plate, which is superior in the uniformity of the grained surface due to electrochemical etching. The present invention also relates to a method of producing the same.

BACKGROUND OF THE INVENTION

Lithographic printing is performed by subjecting a presensitized plate comprising a support body made of an aluminum alloy and a photosensitive material containing a diazo compound that serves as a photosensitive substance to a plate-making treatment such as image exposure or development to form an imaged portion, winding the plate around a cylindrical plate drum of a press, adhering ink onto the imaged portion in the presence of wet water adhered onto the non-imaged portion, transferring ink to a rubber blanket, and printing on the surface of a paper.

As the support body for the presensitized plate, an aluminum alloy plate subjected to a surface treatment such as graining treatment due to electrochemical etching or anodizing oxidation treatment is generally used. As the aluminum alloy used for this purpose, JIS1050(AA1050) alloy (pure aluminum having purity of 99.5% or higher), JIS1100 (AA1100) alloy (Al-0.05~0.20% Cu alloy) and JIS3003 (AA3003) alloy (Al-0.05~0.20% Cu-1.5% Mn alloy) were exclusively used at first.

Such an aluminum alloy support body for the presensitized plate requires various properties such as:

(1) uniform grained surface due to electrochemical etching, (2) good adhesion of photosensitive material, and (3) no strain of the imaged portion during the printing.

However, since JIS1050(AA1050), JIS1100(AA1100) and JIS3003(AA3003) alloys themselves cannot sufficiently satisfy the respective requirements described above, various improvements have been made.

For example, Japanese Patent Application, First Publication No. Sho 58-221254 discloses an offset printing plate consisting essentially of 0.02 to 0.15% of Si; 0.1 to 1.0% of Fe; not more than 0.003% of Cu; and the balance of Al and unavoidable impurities.

Also Japanese Patent Application, First Publication No. Sho 62-148295 discloses a lithographic printing aluminum alloy support body consisting essentially of 0.05 to 1.0% of Fe; not more than 0.2% of Si; not more than 0.05% of Cu; and the balance of Al and unavoidable impurities, the content of a simple substance Si distributed in a constitution being not more than 0.012%.

The invention described in Japanese Patent Application, First Publication No. Sho 58-221254 suggests controlling the Cu content to within 0.003% or less because the corrosion resistance is lowered with the increase of the Cu content, thereby increasing contamination of the non-imaged portion during the printing. The technique described in Japanese Patent Application, First Publication No. Sho 62-148295 has an effect such that a grained surface due to electrochemical etching is obtained and streaking (strip-shaped unevenness) does not occur and, moreover, contamination of the non-image portion can be inhibited during the printing.

Therefore, it has become difficult for conventional aluminum alloy support bodies described in Japanese Patent Application, First Publication No. Sho 58-221254 and Japanese Patent Application, First Publication No. Sho 62-148295 to sufficiently cope with the requirement of an improvement in printing accuracy (or print contrast ratio). Particularly, it has become necessary to further improve the uniformity of the grained surface due to electrochemical etching. Moreover, forming an excellent grained surface having excellent uniformity by an electrochemical graining treatment within a short time for the purpose of reducing the cost has become an important requirement.

To cope with these requirements, Japanese Patent Application, First Publication No. Hei 9-184039 suggests an aluminum alloy support body for a presensitized plate with a composition consisting essentially of 0.25 to 0.6% by weight of Fe; 0.03 to 0.15% by weight of Si; 0.005 to 0.05% by weight Ti; 0.005 to 0.20% by weight Ni; and the balance of Al and unavoidable impurities, the composition satisfying the relationship: $0.1 \leqq Ni/Si \leqq 3.7$.

The aluminum alloy support body for a presensitized plate described in Japanese Patent Application, First Publication No. Hei 9-184039 makes it possible to improve the uniformity of the grained surface and to inhibit formation of pits due to dipping in an electrolytic solution in a non-electrically conducted state before an electrolytic treatment by inhibiting the chemical solubility, which is improved by adding Ni, due to the performance of inhibiting the chemical solubility of Si.

Also Japanese Patent Application, First Publication No. Hei 9-272937 suggests an aluminum alloy support body for a presensitized plate consisting essentially of 0.20 to 0.6% by weight of Fe; 0.03 to 0.15% by weight of Si; 0.006 to 0.05% by weight Ti; and 0.005 to 0.20% by weight Ni; the aluminum alloy support body further containing 0.005 to 0.050% by weight of one or more elements selected from the group consisting of Cu and Zn; 0.001 to 0.020% by weight of one or more elements selected from the group consisting of In, Sn and Pb; and the balance of Al and unavoidable impurities.

In the aluminum alloy support body for a presensitized plate described in Japanese Patent Application, First Publication No. Hei 9-272937, a difference in potential between an aluminum matrix and an intermetallic compound is controlled by incorporating one or more elements of Cu and Zn and one or more elements of In, Sn and Pb into the aluminum matrix in a solid state, thereby making the electrolytically grained surface uniform.

Although the uniformity of the grained surface was improved as compared with the prior art by the suggestions of Japanese Patent Application, First Publication No. Hei 9-184039 and Japanese Patent Application, First Publication No. Hei 9-272937, higher printing accuracy is required and still more uniformity of the grained surface is required at present. Thus, an object of the present invention is to provide an aluminum alloy support body for a presensitized plate in which the uniformity of the grained surface due to electrochemical etching is further improved, and a method of producing the same.

SUMMARY OF THE INVENTION

To solve the problems described above, the present inventors have studied about the uniformity of electrochemical etching of the aluminum alloy support body for a presensitized plate and found the following facts.

(1) An Al—Fe type intermetallic compound, which is crystallized or deposited in an aluminum matrix, acts as a cathode point during the electrochemical etching, thus controlling the solubility of an aluminum alloy support body for a presensitized plate.

(2) When Ni is added, Ni is incorporated into an Al—Fe type intermetallic compound to form an Al—Fe—Ni type intermetallic compound, thus making it possible to improve uniform solubility of an aluminum alloy support body for a presensitized plate.

(3) When rare earth elements are added, said rare earth elements are incorporated into the Al—Fe type intermetallic compound or Al—Fe—Ni type intermetallic compound described above to form crystals/deposits of an Al—Fe—X type or Al—Fe—Ni—X type (wherein X is one or more rare earth elements) intermetallic compound. Since these intermetallic compounds have properties capable of easily producing an electric current as compared with the Al—Fe type or Al—Fe—Ni type intermetallic compound, that is, X-free intermetallic compound, uniform solubility of an aluminum alloy support body for a presensitized plate can be improved by further improving the cathode reactivity during the electrochemical etching.

(4) Zn weakens an oxide layer to be formed on the surface of aluminum, thus improving the uniformity of the grained surface. Provided that excess Zn is added, the effect of weakening the oxide layer becomes too large and the dissolution amount becomes too large during the electrochemical etching, thereby making the uniformity of the grained surface worse.

(5) The uniformity of the grained surface due to electrochemical etching can be secured by controlling the amount of Ni and Zn to be added based on a predetermined relationship.

(6) Although Si forms an Al—Fe—Si intermetallic compound, the uniformity of the grained surface due to electrochemical etching is inhibited when the amount of the Al—Fe—Si type intermetallic compound becomes too large. Accordingly, controlling the content based on the relationship with the Fe content is preferred.

The aluminum alloy support body for the presensitized plate of the present invention has been made based on the knowledge described above, and has a feature that it comprises:

0.1 to 0.7% by weight of Fe; 0.01 to 0.2% by weight of Si; 0.005 to 1.0% by weight of one or more rare earth elements; and the balance of Al and unavoidable impurities.

According to the present invention, it is made possible to form the grained surface due to electrochemical etching more uniformly as compared with a conventional support body.

The aluminum alloy support body for the presensitized plate of the present invention has as a feature that it comprises:

0.1 to 0.7% by weight of Fe; 0.01 to 0.2% by weight of Si; 0.005 to 0.1% by weight of Ni; 0.005 to 0.3% by weight of one or more rare earth elements; and the balance of Al and unavoidable impurities.

According to the present invention, it is made possible to form the grained surface due to electrochemical etching more uniformly as compared with a conventional support body.

The aluminum alloy support body for the presensitized plate of the present invention has a feature that said rare earth elements are one or more elements of Ce, La and Nd.

The aluminum alloy support body for the presensitized plate of the present invention contributes to a further improvement in the uniformity of the grained surface due to electrochemical etching when said rare earth elements are contained in an amount of 0.01 to 0.2%.

The aluminum alloy support body for the presensitized plate of the present invention has as a feature that it comprises:

0.1 to 0.7% by weight of Fe, 0.01 to 0.2% by weight of Si, and unavoidable impurities, wherein this alloy support body has a constitution in which an Al—Fe—X type intermetallic compound and/or an Al—Fe—Ni—X type intermetallic compound (wherein X is one or more rare earth elements) are dispersed.

According to the present invention, it is also made possible to form the grained surface due to electrochemical etching more uniformly as compared with a conventional support body.

In the present invention, said aluminum alloy support body may contain 0.1 to 0.7% by weight of Fe; 0.01 to 0.2% by weight of Si; 0.005 to 0.1% by weight of Ni; and unavoidable impurities.

In the present invention, said rare earth elements may be one or more elements of Ce, La and Nd.

In the present invention, the average grain size of said Al—Fe—X type intermetallic compound and said Al—Fe—Ni—X type intermetallic compound may be 3 $\mu$m ($3\times10^{-6}$ m) or less.

The aluminum alloy support body for the presensitized plate of the present invention has as a feature that it comprises:

0.1 to 0.70% by weight of Fe; 0.01 to 0.20% by weight of Si; 0.005 to 0.075% by weight of Ni; 0.005 to 0.075% by weight of Zn; not more than 0.01% by weight of Cu; 0.005 to 0.3% by weight of one or more rare earth elements; and the balance of Al and unavoidable impurities, wherein the composition of said aluminum alloy support body satisfies the relationships: $Zn(\%)\leqq0.08-Ni(\%)$ and $Fe(\%)\geqq0.1+Si(\%)$, and crystals/deposits of $0.01\leqq d\leqq2$ ($\mu$m: $2\times10^{-6}$ m) in size are present in the matrix thereof in an amount of $1\times10^{3}\leqq n\leqq3\times10^{5}$ (the number/mm$^2$), provided that d is an equivalent-circle diameter of the crystals/deposits and n is the number.

In the present invention, the size and amount of the intermetallic compound as crystals/deposits exert an influence on the uniformity of the grained surface due to electrochemical etching. Although the intermetallic compound having an equivalent-circle diameter d of less than 0.01 $\mu$m ($0.01\times10^{-6}$ m) does not serve as a starting point of etching, the uniformity is likely to be inhibited when the intermetallic compound has an equivalent-circle diameter of larger than 2 $\mu$m ($2\times10^{-6}$ m). When crystals/deposits of the intermetallic compound are present in the amount of less than $1\times10^{3}$, the uniformity of the grained surface is poor because of the small number of intermetallic compounds which serve as an etching point. On the other hand, when crystals/deposits are present in the amount of larger than $3\times10^{5}$, the uniformity of the grained surface is lowered of too high solubility.

One or more elements of Ce, La, and Nd can be used as said rare earth elements in the present invention.

In the present invention, there can be employed crystals/deposits essentially consisting of one or more compounds of an Al—Fe type intermetallic compound, an Al—Fe—Ni type intermetallic compound, and Al—Fe—Si intermetallic compound as said crystals/deposits.

The method of producing an aluminum alloy support body for the presensitized plate of the present invention has as a feature that it comprises:

forming an ingot with a composition comprising 0.1 to 0.7% by weight of Fe; 0.01 to 0.2% by weight of Si; 0.005 to 1.0% by weight of one or more rare earth elements; and the balance of Al and unavoidable impurities;

subjecting the ingot to hot rolling without performing a homogenizing heat treatment;

subjecting the resulting plate to cold rolling and process annealing; and subjecting the plate to finish cold rolling.

According to the method described above, coarsening of the intermetallic compound to be crystallized or deposited can be prevented because an alloy with a composition containing rare earth elements with the composition described above is used, and the homogenizing heat treatment is not performed as described above. Consequently, avoiding uniform etching from being carried out by the proceeding of electrochemical etching in the large intermetallic compound is made possible, thus making it possible to greatly contribute to carry out uniform electrochemical etching.

Therefore, according to the method of the present invention, obtaining an aluminum alloy support body for the presensitized plate in which the grained surface due to electrochemical etching is formed more uniformly as compared with a conventional support body is made possible.

The method of producing an aluminum alloy support body for the presensitized plate of the present invention has as a feature that it comprises:

forming an ingot with a composition comprising 0.1 to 0.7% by weight of Fe, 0.01 to 0.2% by weight of Si, 0.005 to 0.1% by weight of Ni, 0.005 to 0.3% by weight of one or more rare earth elements; and the balance of Al and unavoidable impurities;

subjecting the ingot to hot rolling without performing a homogenizing heat treatment;

subjecting the resulting plate to cold rolling and process annealing; and subjecting the plate to finish cold rolling.

According to the method described above, coarsening of the intermetallic compound to be crystallized or deposited can be prevented because an alloy with a composition containing rare earth elements with the composition described above is used, and the homogenizing heat treatment is not performed as described above. Consequently, avoiding uniform etching from being carried out by the proceeding of electrochemical etching in the large intermetallic compound, thus making it possible to greatly contribute to carrying out uniform electrochemical etching is made possible.

Therefore, according to the method of the present invention, obtaining an aluminum alloy support body for the presensitized plate in which the grained surface due to electrochemical etching is formed more uniformly as compared with a conventional support body is made possible.

The method of producing an aluminum alloy support body for the presensitized plate of the present invention has as a feature that it comprises:

forming an ingot with a composition comprising 0.1 to 0.7% by weight of Fe; 0.01 to 0.2% by weight of Si; 0.005 to 0.1% by weight of Ni; 0.005 to 0.075% by weight of Zn, not more than 0.01% by weight of Cu; 0.005 to 0.3% by weight of one or more rare earth elements; and the balance of Al and unavoidable impurities;

subjecting the ingot to hot rolling without performing a homogenizing heat treatment;

subjecting the resulting plate to cold rolling and process annealing; and subjecting the plate to finish cold rolling.

According to the method described above, coarsening of the intermetallic compound to be crystallized or deposited can be prevented because an alloy with a composition containing rare earth elements with the composition described above is used, and the homogenizing heat treatment is not performed as described above. Consequently, avoiding uniform etching from being carried out by the proceeding of electrochemical etching in the large intermetallic compound is made possible, thus making it possible to greatly contribute to carrying out uniform electrochemical etching.

Therefore, according to the present invention, obtaining an aluminum alloy support body for the presensitized plate in which the grained surface due to electrochemical etching is formed more uniformly as compared with a conventional support body is made possible.

The components in the present invention and reasons for limitation will be described below.

<Fe: 0.1 to 0.7%>

Fe forms an Al—Fe type intermetallic compound, thereby improving the uniformity of the grained surface due to electrochemical etching and to improve the fatigue strength. However, when the Fe content is less than 0.1%, these effect is insufficient. On the other hand, when the Fe content exceeds 0.7%, the uniformity of the grained surface due to electrochemical etching tends to be impaired due to coarsening of the intermetallic compound. Therefore, the Fe content was controlled within a range from 0.1 to 0.7%. The Fe content is preferably within a range from 0.2 to 0.4%, and more preferably from 0.2 to 0.3%.

In the present specification, in the case that the range of a numerical value is limited by using ". . . to . . . ", the upper limit and lower limit mean "not less than" and "not more than", respectively, unless otherwise stated. Therefore, "0.2 to 0.4%" means not less than 0.2% and not more than 0.4%.<Si: 0.01 to 0.20%>.

Si forms an Al—Fe—Si type intermetallic compound, thereby accelerating the refining of recrystallized grains during the hot rolling. When the Si content is less than 0.01%, coarse grains are generated because of lack of this effect, thereby impairing the uniformity of the grained surface due to electrochemical etching and to form a light non-etched portion referred to as a "streak". On the other hand, when the Si content exceeds 0.20%, the Al—Fe—Si type intermetallic compound is coarsened, thereby impairing the uniformity of the grained surface due to electrochemical etching. Therefore, the Si content was controlled within a range from 0.01 to 0.20% in the present invention. The Si content may be preferably controlled within a range from 0.02 to 0.2%, and more preferably from 0.04 to 0.08%.

We note that when the Si content becomes too large in relation to Fe, the amount of the Al—Fe—Si type intermetallic compound is likely to increase, thereby impairing the uniformity of the grained surface due to electrochemical etching. Accordingly, it is preferred to satisfy the relationship: $Fe(\%) \geqq 0.1+Si(\%)$ in the present invention, as described above.

<Cu: not more than 0.01%>

Cu is an element which impairs the uniformity of the grained surface due to electrochemical etching. In the present invention, the Cu content is preferably reduced to not more than 0.01%, and more preferably to not more than 0.005%.

<Ni: 0.005 to 0.1%>

Ni has an effect of improving uniform solubility by being incorporated into an Al—Fe type intermetallic compound to form an Al—Fe—Ni type intermetallic compound. However, when the Ni content is less than 0.005%, the effect of improving the uniformity of the grained surface due to electrochemical etching is not sufficient because of lack of this effect. On the other hand, when the Ni content exceeds 0.1%, the Al—Fe—Si type intermetallic compound is coarsened, thereby to make a grained surface due to electrochemical etching ununiform. Therefore, the Ni content is controlled within a range from 0.005 to 0.10% in the present invention. The Ni content is more preferably within a range from 0.01 to 0.03%.

<Ce+La+Nd: 0.005 to 1.0%>

Rare earth elements are respectively incorporated into the Al—Fe type intermetallic compound or an Al—Fe—Ni type intermetallic compound to form crystals/deposits of an Al—Fe—X type intermetallic compound or Al—Fe—Ni—X type intermetallic compound (x is one or more rare earth elements). The crystals/deposits of these intermetallic compounds further improve the cathode reactivity during the electrochemical etching, thereby to improve uniform solubility. However, when the (Ce+La+Nd) content is less than 0.005%, it becomes impossible to sufficiently obtain the effect. On the other hand, when the (Ce+La+Nd) content exceeds 1.0%, coarse crystals/deposits are formed, thereby making etching ununiform. We note that the content of rare earth elements is preferably within a range from 0.005 to 0.3%, more preferably from 0.01 to 0.2%, and most preferably from 0.01 to 0.1%.

As the rare earth elements, one or more elements of lanthanoid elements can be appropriately used. In the present invention, one or more elements of Ce, La and Nd is preferably used. With regard to these, Ce, La and Nd, each pure metal may be added to aluminum so as to satisfy the conditions described above. In the present invention, the conditions described above may be satisfied by the method of adding a so-called mischmetal produced as a mixture of Ce, La and Nd without using the method of adding pure metals. This method is advantageous in view of its cost. Although the mischmetal sometimes contain about several % of Pr, a trace amount of Pb, and P and S as metallic elements other than Ce, La and Nd, the effect of the present invention is not impaired even if they are contained. In case rare earth elements are added only by using the mischmetal, the amount of the mischmetal is preferably controlled within a range from 0.05 to 1.0% in view of the preparation.

<Other Impurity Elements>

Although the aluminum alloy support body for the presensitized plate of the present invention contains impurity elements other than the elements described above, the object of the present invention is not impaired as far as the content thereof is within the following range:

Mg: not more than 0.1%; Ti: not more than 0.05%; V: not more than 0.05%; and B: not more than 0.05%.

The size and amount of the Al—Fe type intermetallic compound in the aluminum alloy support body for the presensitized plate of the present invention will be described below.

The size and amount of the Al—Fe intermetallic compound are influenced by the casting conditions (mainly cooling rate), homogenizing treatment performed after casting, and hot rolling and cold rolling conditions (mainly rolling reduction).

In the present invention, it is effective to omit the homogenizing treatment which is usually performed in case of this kind of an aluminum alloy. While the homogenizing treatment has such an advantage that the Al—Fe type intermetallic compound is uniformly dispersed in the matrix, the Al—Fe intermetallic compound is coarsened. Therefore, it is considered to be effective to improve the uniformity of the grained surface by preventing coarsening of the Al—Fe intermetallic compound, in the present invention. However, performing no homogenizing treatment is one means to make the present invention more effective but the present invention is not specifically limited by this fact.

The following description explains the mechanism wherein uniform solubility is improved during the electrochemical etching by forming crystals/deposits of the Al—Fe—X type or Al—Fe—Ni—X type intermetallic compound.

When AC power is connected to an aluminum material wherein each intermetallic compound is crystallized or deposited to be used as one of electrodes for electrochemical etching, the aluminum material exhibits both of anode and cathode reactions.

During the anode reaction, the following reaction proceeds, thereby to elute aluminum in a solution and to emit electrons.

$$Al \rightarrow Al^{3+} + 3e^- \quad (1)$$

That is, it is a main reaction of etching.

During the cathode reaction, the following reaction proceeds.

$$2H^+ + 2e^- \rightarrow H_2(gas) \quad (2)$$

A cleaning operation is carried out on the surface of the aluminum material by the reaction of the scheme (2). That is, smut such as $Al(OH)_3$ is removed from the surface of the aluminum material. Such a cleaning effect is effective to further proceeding of etching.

Such a reaction is mainly performed in the Al—Fe—X type or Al—Fe—Ni—X type intermetallic compound crystallized/deposited on the surface of the aluminum material. The reason is that an electric current is liable to be produced in these intermetallic compounds so that the cathode reaction is liable to occur. For example, these intermetallic compounds have properties wherein the cathode reaction is liable to occur, as compared with the x-free Al—Fe—Ni type intermetallic compound (x: rare earth elements).

In general, ease of the occurrence of the cathode reaction in such an intermetallic compound strongly depends on the size of the intermetallic compound. The larger the size, the more easily the reaction occurs. As a result, in case the Al—Fe type intermetallic compound, which can form large crystals/deposits, is present, progress of the reactions (1) and (2) finally is likely to cause ununiform etching. In case of a X-free Al—Fe—Ni type intermetallic compound, ununiform etching occurs finally because ease of producing an electric current also strongly depends on the size of the intermetallic compound. However, the intermetallic compounds containing X essentially has properties capable of "easily producing an electric current" so that said properties do not strongly depend on the size of the Al—Fe type intermetallic compound. As a result, the surface of the aluminum material is uniformly etched.

In the aluminum alloy support body for the presensitized plate of the present invention, which comprising 0.1 to 0.7% by weight of Fe; 0.01 to 0.2% by weight of Si; 0.005 to 1.0% by weight of one or more rare earth elements; and the balance of Al and unavoidable impurities, or comprising 0.1 to 0.7% by weight of Fe; 0.01 to 0.2% by weight of Si; 0.005 to 0.1% by weight of Ni; 0.005 to 0.3% by weight of one or more rare earth elements; and the balance of Al and unavoidable impurities, said alloy support body has a constitution in which an Al—Fe—X type intermetallic compound and/or an Al—Fe—Ni—X type intermetallic compound (wherein X is one or more rare earth elements) are dispersed. With regard to these alloy support bodies, the same effect described above can be given.

The crystals/deposits of the aluminum alloy support body for the presensitized plate of the present invention will be described in detail below.

According to the present inventors' study, the size and amount of the intermetallic compound as the crystals/deposits exert an influence on the uniformity of the grained surface due to electrochemical etching. Although the intermetallic compound having an equivalent-circle diameter d of less than 0.01 $\mu$m ($0.01\times10^{-6}$ m) does not serve as a starting point of etching, the uniformity is impaired when the equivalent-circle diameter exceeds 2 $\mu$m ($2\times10^{-6}$ m). When the amount of the intermetallic compound is less than $1\times10^3/mm^2$, the uniformity of the grained surface is poor because of small number of metallic compounds which serve as an etching point. On the other hand, the amount exceeds $3\times10^5/mm^2$, the uniformity of the grained surface is lowered of too high solubility.

The size and amount of the crystals/deposits are influenced by the casting conditions (mainly cooling rate), homogenizing treatment performed after casting, and hot rolling and cold rolling conditions (mainly rolling reduction). In the present invention, it is effective to omit the homogenizing treatment which is usually performed in case of this kind of an aluminum alloy. The homogenizing treatment has such an advantage that the crystals/deposits are uniformly dispersed in the matrix, however, the crystals/deposits are coarsened. Therefore, it is effective to improve the uniformity of the grained surface by preventing coarsening of the crystals/deposits, in the present invention.

The matter to be studied in the preparation, which are effective to the aluminum alloy support body for the presensitized plate of the present invention, will be described below.

<Casting>

The casting method is not specifically limited in the preparation of the aluminum alloy support body for the presensitized plate of the present invention. For example, a conventionally known casting method such as DC casting method can be applied.

<Heat Treatment>

In general, the ingot obtained by casting is subjected to a homogenizing heat treatment at a temperature within a range from 450 to 600° C. By this homogenizing heat treatment, a portion of Fe is incorporated in a solid state and an Al—Fe intermetallic compound is dispersed uniformly and finely. However, it is not necessarily an essential process in the present invention, as described above. After the completion of the homogenizing heat treatment, the subsequent process, a soaking treatment for hot rolling can also be performed once the ingot has cooled. However, the hot rolling can also be performed immediately after homogenizing heat treatment.

Even in case of performing the homogenizing heat treatment, the temperature and retention time are preferably controlled so that crystals/deposits of $0.01\leqq d\leqq 2$ ($\mu$m: $2\times10^{-6}$ m) in size are present in an amount of $1\times10^3\leqq n\leqq 3\times10^5$ (the number/$mm^2$), provided that d is an equivalent-circle diameter of the crystals/deposits and n is the number. After the completion of the homogenizing heat treatment, the subsequent process, a soaking treatment for hot rolling can be performed after the ingot was once cooled. However, the hot rolling can also be performed immediately after homogenizing heat treatment.

<Hot Rolling>

Hot rolling is performed after being subjected to the homogenizing heat treatment. Hot rolling is preferably performed at a temperature within a range from 300 to 600° C. When the temperature exceeds 600° C., the recrystallized grains are liable to be coarsened, thereby to generate streaks due to the graining treatment.

<Cold Rolling>

After the completion of hot rolling, cold rolling is performed. The Al—Fe type intermetallic compound is dispersed by this cold rolling, thereby to make the grain uniform and fine. It is necessary to control the rolling reduction to 50%, and preferably not less than 70%, so as to obtain this effect.

<Annealing>

For the main purpose of imparting proper strength and elongation to the plate, annealing is performed after the completion of cold rolling. Annealing is performed at a temperature within a range from 300 to 600° C. When the temperature is less than 3000, the object can not be attained. On the other hand, when the temperature exceeds 600° C., the surface is severely oxidized, which is not preferred. The annealing temperature is preferably within a range from 350 to 500° C. Annealing may be performed by using any of a continuous annealing furnace and a batch-wise annealing furnace.

<Finish Cold Rolling>

After the completion of the annealing, cold rolling is performed again. This cold rolling is performed for the purpose of adjusting to the hardness required for the aluminum alloy support body for the presensitized plate. Since the hardness required for the aluminum alloy support body for the presensitized plate is H16 (BY JIS4000), the rolling reduction is controlled to meet the value.

<Surface Treatment>

After the completion of the finish cold rolling, a graining treatment caused by electrochemical etching is performed by dipping in an electrolytic solution such as hydrochloric acid, nitric acid, or the like. The roughening treatment is performed to improve the adhesion to the photosensitive layer in the imaged portion and to improve the hydrophilicity and water retention in the non-imaged portion. After the completion of the roughening treatment, the wear resistance and hydrophilicity of the surface can also be improved by performing an anodizing oxidation treatment.

As described above, since the homogenizing heat treatment is not performed in the method of preparing the aluminum alloy support body for the presensitized plate, coarsening of the intermetallic compound to be crystallized or deposited can be prevented. Consequently, avoiding uniform etching from being carried out by the proceeding of electrochemical etching in the large intermetallic compound is made possible, thus making it possible to greatly contribute to carry out uniform electrochemical etching.

DESCRIPTION OF PREFERRED EMBODIMENTS

The present invention will be described by way of the following embodiments.

<First Embodiment>

A slab made of an alloy with the composition (% by weight) shown in Table 1 was obtained by the DC casting method. The casting rate is 30 mm/min and the slab thickness is 200 mm. A plate-shaped test material having a thickness of 0.3 mm was obtained by subjecting this slab to hot rolling at 510° C., annealing and cold rolling in order.

The resulting test material was degreased by dipping in an aqueous 10% sodium hydroxide solution at 50° C. for 30 seconds, and then subjected to a desmut treatment which is performed by dipping in 2% hydrochloric acid at 25° C. for 30 seconds. This test material was dipped in a 2% hydrochloric solution at 25° C., subjected to AC electrochemical etching using a sinusoidal wave of 60 Hz and 60 A/$dm^2$, subjected to a desmut treatment which is performed by dipping in an aqueous 10% sodium hydroxide solution at 50° C. for 6 seconds and dipping in 10% nitric acid at 25° C. for 30 seconds, and then dried.

After drying, the uniformity of the pits was evaluated by taking a microphotograph of the grained surface (0.0252 $mm^2$) using a scanning electron microrange (SEM, magnification: 500×). The evaluation was performed by the following criteria. Samples where the total area of pits having an equivalent-circle diameter of larger than 5 $\mu$m ($5\times10^{-6}$ m) is less than 5% of the evaluated area were rated "○", while samples where the total area of pits having an equivalent-circle diameter of larger than 5 $\mu$m ($5\times10^{-6}$ m) is not less than 5% of the evaluated area were rated "×". The etched surface (50×100 $mm^2$) was visually observed and samples where a non-etched portion was observed were rated "×", while samples where a non-etched portion was not observed were rated "○".

The results are also shown in Table 1. As is apparent from the results, samples No. 1 to No. 10 of the embodiments are superior in uniformity of the pits and are also superior in uniformity of the grained surface due to electrochemical etching because the non-etched portion was not observed.

TABLE 1

| | | Chemical components | | | | | | | Evaluation | |
|---|---|---|---|---|---|---|---|---|---|---|
| | Sample No. | Fe | Si | Ni | Ce | La | Nd | Ce + La + Nd | A | B |
| Embodiments | 1 | 0.24 | 0.06 | 0.029 | 0.005 | 0.002 | 0.001 | 0.008 | ○ | ○ |
| | 2 | 0.24 | 0.06 | 0.029 | 0.015 | 0.006 | 0.005 | 0.026 | ○ | ○ |
| | 3 | 0.24 | 0.06 | 0.029 | 0.110 | 0.043 | 0.034 | 0.187 | ○ | ○ |
| | 4 | 0.31 | 0.06 | 0.002 | 0.045 | 0.03 | 0.015 | 0.09 | ○ | ○ |
| | 5 | 0.33 | 0.06 | 0.002 | 0.135 | 0.09 | 0.045 | 0.27 | ○ | ○ |
| | 6 | 0.31 | 0.06 | 0.012 | 0.005 | 0.003 | 0.002 | 0.01 | ○ | ○ |
| | 7 | 0.31 | 0.06 | 0.002 | 0.51 | 0.17 | 0.17 | 0.85 | ○ | ○ |
| | 8 | 0.31 | 0.06 | 0.002 | 0.025 | 0.01 | 0.015 | 0.05 | ○ | ○ |
| | 9 | 0.31 | 0.06 | 0.040 | 0.003 | 0.001 | 0.001 | 0.005 | ○ | ○ |
| | 10 | 0.31 | 0.06 | 0.10 | 0.005 | 0.003 | 0.002 | 0.01 | ○ | ○ |
| Comp. Embodiments | 11 | 0.25 | 0.06 | 0.01 | Tr. | Tr. | Tr. | — | X | ○ |
| | 12 | 0.75 | 0.06 | 0.029 | 0.013 | 0.005 | 0.004 | 0.022 | X | X |
| | 13 | 0.25 | 0.11 | 0.029 | 0.218 | 0.072 | 0.060 | 0.350 | X | X |
| | 14 | 0.31 | 0.06 | 0.002 | 0.63 | 0.42 | 0.42 | 1.26 | X | ○ |
| | 15 | 0.31 | 0.06 | 0.002 | 0.002 | 0.001 | 0.001 | 0.004 | X | X |
| | 16 | 0.31 | 0.06 | 0.025 | 0.002 | 0.001 | 0.001 | 0.004 | X | ○ |

A: Etching uniformity
B: Evaluation of non-etched portion

Regarding the sample No. 1 of the embodiment, the content of (Ce+La+Nd) was adjusted to 0.008%. It is apparent that this content satisfies the range of the present invention, that is, the conditions of the content in case of containing Ni<(Ce+La+Nd): 0.005 to 0.3%>. The Fe content, Si content and Ni content are 0.24%, 0.06% and 0.029%, respectively, and satisfy the respective conditions of the present invention. It is apparent that both of the evaluations of uniformity of the etching and non-etching properties are good in such a case. In the surface of the sample, the total area of pits having an equivalent-circle diameter of larger than 5 $\mu$m ($5\times10^{-6}$ m) is not more than 5% of the evaluated area and the evaluated surface was uniformly etched. As is apparent from the observation of the etched surface ($50\times100$ mm$^2$) the non-etched portion was not observed.

Regarding samples No. 2 and No. 3 of the embodiments, the content of (Ce+La+Nd) was adjusted to 0.026% and 0.187%, respectively. It is apparent that these contents also satisfy the conditions of the present invention. The conditions of Fe, Si and Ni are the same as those in the sample No. 1 of the embodiment. It is apparent that both of the evaluations of the uniformity of the etching and non-etching properties are good in such a case.

On the other hand, the sample No. 11 of the comparative embodiment does not contain (Ce+La+Nd). We note here that the symbol "tr." in Table 1 means that each element described above is contained in an amount of less than 0.001% by weight, in other words, it means samples which do not substantially contain said element. Therefore, this does not satisfy the conditions of the present invention. The Fe content, Si content and Ni content are 0.25%, 0.06% and 0.01%, respectively, and satisfy the respective conditions of the present invention. As is apparent from Table 1, the evaluation of the non-etched portion is good but the uniformity of the etching is not good. Therefore, samples of the comparative embodiments are generally inferior as compared to the results of the samples No. 1 to No. 10 of the embodiments.

In the sample No. 12 of the comparative embodiment, the content of (Ce+La+Nd) is 0.022% and satisfies the conditions of the present invention. However, the Fe content is 0.75% and does not satisfy the conditions with respect to Fe, i.e. <Fe: 0.1 to 0.7%>. The Si content and Ni content are the same as those in sample No. 11 of the comparative embodiment. As is apparent from Table 1, neither of the evaluations of the uniformity of the etching and non-etching properties is good in such a case. It is apparent that not only Ce, La and Nd, but also other elements must satisfy the respective conditions of the present invention.

In the sample No. 13 of the comparative embodiment, the content of (Ce+La+Nd) is 0.350% and deviates from the upper limit of the conditions of the rare earth element content of the present invention. The Fe content, Si content and Ni content are 0.25%, 0.11% and 0.029%, respectively, and satisfy the respective conditions of the present invention.

As described above, since the present invention provides an aluminum alloy support body for the presensitized plate consisting essentially of 0.1 to 0.7% by weight of Fe; 0.01 to 0.2% by weight of Si; 0.005 to 0.1% Ni; 0.005 to 0.3% by weight of one or more rare earth elements; and the balance of Al and unavoidable impurities, it is made possible to form the grained surface due to electrochemical etching more uniformly as compared with a conventional support body.

In the composition which contains minor metal element of Ni, good etching properties were also obtained with respect to the samples Nos. 4, 5, 7 and 8 which satisfy the conditions of the present invention. On the other hand, regarding both of the sample No. 14 of the comparative embodiment wherein the rare earth element content was larger than the range of the present invention and the sample No. 15 of the comparative embodiment wherein the rare earth element content was smaller than the range of the present invention, either the evaluation A or A and B became inferior. Therefore, the aluminum alloy support body for the presensitized plate of the present invention can form the grained surface due to electrochemical etching more uniformly as compared with a conventional support body even in case of the composition which is substantially free from Ni.

<Second Embodiment>

A slab made of an aluminum alloy with the composition (% by weight) shown in Table 2 was obtained by the DC casting method. The casting rate is 30 mm/min and the slab thickness is 200 mm. A plate-shaped aluminum alloy test material having a thickness of 0.3 mm was obtained by heating this slab to 510° C., and subjecting to hot rolling, annealing and cold rolling in order.

The resulting aluminum alloy test material was degreased by dipping in an aqueous 10% sodium hydroxide solution at 50° C. for 30 seconds, and then subjected to a desmut treatment which is performed by dipping in 10% nitric acid at 25° C. for 30 seconds. This test material was dipped in a 2% hydrochloric solution at 250, subjected to AC electrochemical etching using a sinusoidal wave of 60 Hz and 50 A/dm$^2$, subjected to a desmut treatment which is performed by dipping in an aqueous 10% sodium hydroxide solution at 50° for 6 seconds and dipping in 10% nitric acid at 25° for 30 seconds, and then dried.

After drying, the uniformity of the pits was evaluated by taking a microphotograph of the grained surface (0.0252 mm$^2$) of the aluminum alloy sample using a scanning electron microrange (SEM, magnification: 500×). The evaluation was performed by the following criteria. Samples where the total area of pits having an equivalent-circle diameter of larger than 5 $\mu$m ($5\times10^{-6}$ m) is less than 5% of the evaluated area were rated "○", while samples where the total area of pits having an equivalent-circle diameter of larger than 5 $\mu$m ($5\times10^{-6}$ m) is not less than 5% of the evaluated area were rated "×".

The etched surface (50×100 mm$^2$) of the aluminum alloy sample was visually observed and samples where a non-etched portion was observed were rated "×", while samples where a non-etched portion was not observed were rated "○". The results are also shown in Table 2.

Regarding the sample No. 21 of the comparative embodiment, since the Zn content does not reach the range of the present invention, the effect of weakening the oxide layer of the aluminum surface becomes insufficient, the uniformity of the pits was poor and the non-etched portion was observed.

Regarding the sample No. 22 of the comparative embodiment, since the Si content exceeds the range of the present invention and the Zn content does not reach the range of the present invention (the symbol "tr." in Table 2 means that the content is less than 0.001% by weight, in other words, it means the sample does not substantially contain the element), the uniformity of the pits was poor and the non-etched portion was observed.

Regarding the sample No. 23 of the comparative embodiment, since the Si content exceeds the range of the present invention and does not satisfy the relationship: Fe(%) ≧0.1+Si(%) in the relationship with Fe, the uniformity of the pits was poor.

Regarding the sample 24 of the comparative embodiment, crystals/deposits of 0.01≦d≦2 ($\mu$m: $2\times10^{-6}$ m) in size are present in an amount larger than the range of $1\times10^3 \leqq n \leqq 3\times10^5$ (the number/mm$^2$), though the composition is included in the range of the present invention. Therefore, a non-etched portion was observed.

Regarding the sample No. 25 of the comparative embodiment, since the Cu content exceeds the range of the present invention, the uniformity of the pits was poor and a non-etched portion was observed.

TABLE 2

| | No. | Fe | Si | Ni | Zn | Cu | REM | Al | 0.08 − Ni | 0.1 + Si | Number of crystals/deposits of 0.01 ≦ d ≦ 2 in size ($\mu$m) | Uniformity | Non-etched |
|---|---|---|---|---|---|---|---|---|---|---|---|---|---|
| Embodi- | 17 | 0.24 | 0.06 | 0.029 | 0.028 | 0.033 | A | Bal. | 0.051 | 0.16 | $1\times10^3$–$3\times10^5$ | ○ | ○ |
| ments | 18 | 0.24 | 0.06 | 0.019 | 0.039 | 0.002 | B | Bal. | 0.061 | 0.16 | $1\times10^3$–$3\times10^5$ | ○ | ○ |
| | 19 | 0.24 | 0.06 | 0.021 | 0.021 | 0.002 | C | Bal. | 0.059 | 0.16 | $1\times10^3$–$3\times10^5$ | ○ | ○ |
| Comp. | 20 | 0.31 | 0.06 | 0.029 | 0.081 | 0.001 | — | Bal. | 0.051 | 0.16 | $1\times10^3$–$3\times10^5$ | X | ○ |
| Embodi- | 21 | 0.25 | 0.06 | 0.028 | 0.004 | 0.003 | — | Bal. | 0.052 | 0.16 | $1\times10^3$–$3\times10^5$ | X | X |
| ments | 22 | 0.25 | 0.21 | 0.029 | tr. | 0.003 | — | Bal. | 0.031 | 0.31 | $1\times10^3$–$3\times10^5$ | X | X |
| | 23 | 0.26 | 0.29 | 0.030 | 0.028 | 0.003 | — | Bal. | 0.030 | 0.39 | $1\times10^3$–$3\times10^5$ | X | X |
| | 24 | 0.38 | 0.09 | 0.029 | 0.028 | 0.002 | — | Bal. | 0.031 | 0.19 | $4\times10^5$ | X | ○ |
| | 25 | 0.24 | 0.06 | 0.029 | 0.028 | 0.02 | — | Bal. | 0.031 | 0.16 | $1\times10^3$–$3\times10^5$ | X | X |
| | 26 | 0.30 | 0.05 | 0.027 | 0.035 | 0.002 | 0.35 | Bal. | 0.053 | 0.15 | $1\times10^3$–$3\times10^5$ | X | ○ |

The symbol A in the column labeled REM in the sample No. 17 of the second embodiment means that the mischmetal as the rare earth elements is contained in the total amount of 0.03% by weight (Ce: 0.020% by weight; La: 0.006% by weight; Nd: 0.004% by weight) and the symbol B in the column labeled REM in the sample No. 18 means that the mischmetal as the rare earth elements is contained in the total amount of 0.05% by weight (Ce: 0.033% by weight; La: 0.010% by weight; Nd: 0.007% by weight) and, furthermore, the symbol C in the column labeled REM in the sample No. 19 means that the mischmetal as the rare earth elements is contained in the total amount of 0.16% by weight (Ce: 0.106% by weight; La: 0.036% by weight; Nd: 0.018% by weight).

It is apparent that the aluminum alloy samples No. 17 to No. 19 of the embodiments according to the present invention are superior in the uniformity of their pits and are also superior in the uniformity of their grained surface due to electrochemical etching because a non-etched portion was not observed.

Regarding the sample No. 20 of the comparative embodiment, since the Zn content is larger than the range of the present invention, the solubility is too enhanced, thereby inhibiting the uniformity of the pits.

Regarding the sample No. 26 of the comparative embodiment, since the total amount (total amount of rare earth elements) of the mischmetal is not within the range of the present invention, the uniformity of the pits was poor.

As shown in Table 2, according to the aluminum alloy support body for the presensitized plate with a composition consisting essentially of 0.1 to 0.70% by weight of Fe; 0.01 to 0.20% by weight of Si; 0.005 to 0.075% by weight of Ni; 0.005 to 0.075% by weight of Zn; not more than 0.01% by weight of Cu; 0.005 to 0.3% by weight of one or more rare earth elements; and the balance of Al and unavoidable impurities, wherein the composition of said aluminum alloy support body satisfies the relationships: Zn(%)≦0.08−Ni (%) and Fe(%) ≧0.1+Si(%), and crystals/deposits of 0.01≦d≦2 ($\mu$m: $2\times10^{-6}$ m) in size are present in the matrix thereof in an amount of $1\times10^3 \leqq n \leqq 3\times10^5$ (the number/mm$^2$), provided that d is an equivalent-circle diameter of the crystals/deposits and n is the number, forming the grained surface due to electrochemical etching more uniformly as compared with a conventional aluminum alloy support body is made possible.

What is claimed is:

1. A presensitized plate comprising an aluminum alloy support body having a uniform grained surface due to electrochemical etching and a photosensitive material which is supported by said uniform grained surface, said aluminum alloy support body comprising:

0.1 to 0.7% by weight of Fe; 0.01 to 0.2% by weight of Si; 0.005 to 1.0% by weight of at least one rare earth element; and the balance Al and unavoidable impurities, wherein aggregates of $0.01 \leqq d \leqq 2$ μm in size are present in said aluminum support body in an amount of $1\times10^3 \leqq n \leqq 3\times10^5$, wherein d is an equivalent-circle diameter of the aggregates and n is the number of aggregates per $mm^2$.

2. A presensitized plate according to claim 1 wherein said rare earth element is selected from the group consisting of Ce, La, and Nd.

3. A presensitized plate according to claim 1, wherein said rare earth element is present in an amount of 0.01 to 0.2% by weight.

4. A presensitized plate according to claim 1, wherein said photosensitive material is a diazo compound.

5. A presensitized plate according to claim 1, wherein said aluminum alloy support body comprises 0.24 to 0.33% by weight of Fe; 0.01 to 0.2% by weight of Si; 0.005 to 1.0% by weight of at least one rare earth element; and unavoidable impurities.

6. A presensitized plate according to claim 1, wherein said aggregates comprise one or more compounds selected from the group consisting of an Al—Fe type intermetallic compound, an Al—Fe—X type intermetallic compound, and Al—Fe—Si type intermetallic compound, wherein X is at least one rare earth element.

7. A presensitized plate according to claim 1, wherein said aluminum alloy support body comprises 0.24 to 0.33% by weight of Fe; 0.01 to 0.2% by weight of Si; 0.005 to 1.0% by weight of at least one rare earth element; and unavoidable impurities.

8. A presensitized plate comprising an aluminum alloy support body having a uniform grained surface due to electrochemical etching and a photosensitive material which is supported by said uniform grained surface, said aluminum alloy support body comprising:

0.1 to 0.7% by weight of Fe; 0.01 to 0.2% by weight of Si; 0.005 to 0.1% by weight of Ni; 0.005 to 0.3% by weight of at least one rare earth element and the balance Al and unavoidable impurities, wherein aggregates of $0.01 \leqq d \leqq 2$ μm in size are present in said aluminum support body in an amount of $1\times10^3 \leqq n \leqq 3\times10^5$, wherein d is an equivalent-circle diameter of the aggregates and n is the number of aggregates per $mm^2$.

9. A presensitized plate according to claim 8, wherein said rare earth element is selected from the group consisting of Ce, La, and Nd.

10. A presensitized plate according to claim 8, wherein said rare earth element is present in an amount of 0.01 to 0.2% by weight.

11. A presensitized plate according to claim 8, wherein said photosensitive material is a diazo compound.

12. A presensitized plate according to claim 8, wherein said aggregates comprise one or more compounds selected from the group consisting of an Al—Fe type intermetallic compound, an Al—Fe—X intermetallic compound, and Al—Fe—Si type intermetallic compound, wherein X is at least one rare earth element.

13. A presensitized plate according to claim 8, wherein said aluminum alloy support body comprises 0.24 to 0.33% by weight of Fe; 0.01 to 0.2% by weight of Si; 0.005 to 1.0% by weight of at least one rare earth element; and unavoidable impurities.

14. A presensitized plate comprising an aluminum alloy support body having a uniform grained surface due to electrochemical etching and a photosensitive material, said aluminum alloy support body comprising:

0.1 to 0.70% by weight of Fe; 0.01 to 0.20% by weight of Si; 0.005 to 0.075% by weight of Ni; 0.005 to 0.075% by weight of Zn; not more than 0.01% by weight of Cu; 0.005 to 0.3% by weight of at least one rare earth element; and the balance Al and unavoidable impurities, wherein aggregates of $0.01 \leqq d \leqq 2$ μm in size are present in said aluminum support body in an amount of $1\times10^3 \leqq n \leqq 3\times10^5$, wherein d is an equivalent-circle diameter of the aggregates and n is the number of aggregates per $mm^2$, and said aggregates comprise one or more compounds selected from the group consisting of an Al—Fe type intermetallic compound, an Al—Fe—Ni type intermetallic compound, and Al—Fe—Si type intermetallic compound.

15. A presensitized plate according to claim 14, wherein said rare earth element is at least one selected from the group consisting of Ce, La, and Nd.

16. A presensitized plate according to claim 14, wherein the aluminum alloy support body has a composition satisfying the relationships:

(i) % by weight of $Zn \leqq 0.08-$% by weight of Ni and (ii) % by weight of $Fe \geqq 0.1+$% by weight of Si.

17. A presensitized plate according to claim 14, wherein said rare earth element is present in an amount of 0.01 to 0.2% by weight.

18. A presensitized plate according to claim 14, wherein said photosensitive material is a diazo compound.

* * * * *

UNITED STATES PATENT AND TRADEMARK OFFICE

CERTIFICATE OF CORRECTION

PATENT NO. : 6,572,715 B2
DATED : June 3, 2003
INVENTOR(S) : Hirotaka Komine et al.

It is certified that error appears in the above-identified patent and that said Letters Patent is hereby corrected as shown below:

Column 16,
Line 9, after "Al—Fe—X", insert -- type --.

Signed and Sealed this

Eighteenth Day of November, 2003

JAMES E. ROGAN
*Director of the United States Patent and Trademark Office*